US009126405B2

(12) United States Patent
Sugiura et al.

(10) Patent No.: US 9,126,405 B2
(45) Date of Patent: Sep. 8, 2015

(54) LIQUID EJECTION APPARATUS

(71) Applicants: Keita Sugiura, Toyoake (JP); Shingo Hattori, Nagoya (JP)

(72) Inventors: Keita Sugiura, Toyoake (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/220,238

(22) Filed: Mar. 20, 2014

(65) Prior Publication Data

US 2014/0292887 A1 Oct. 2, 2014

(30) Foreign Application Priority Data

Mar. 29, 2013 (JP) ..... 2013-074637

(51) Int. Cl.

| | |
|---|---|
| ***B41J 29/393*** | (2006.01) |
| ***B41J 2/07*** | (2006.01) |
| ***B41J 2/175*** | (2006.01) |
| ***B41J 29/377*** | (2006.01) |
| ***B41J 2/045*** | (2006.01) |
| ***B41J 2/14*** | (2006.01) |

(52) U.S. Cl.

CPC ..... *B41J 2/072* (2013.01); *B41J 2/04551* (2013.01); *B41J 2/04563* (2013.01); *B41J 2/04581* (2013.01); *B41J 2/14209* (2013.01); *B41J 2/175* (2013.01); *B41J 29/377* (2013.01); *B41J 2002/14225* (2013.01); *B41J 2002/14306* (2013.01); *B41J 2202/08* (2013.01); *B41J 2202/20* (2013.01)

(58) Field of Classification Search

CPC ..... B41J 29/3935; B41J 2/125; B41J 2/0451; B41J 2/2142; B41J 11/0095; B41J 2/2146; B41J 2/01; B41J 2/2139; B41J 2/04581; B41J 2/04563; B41J 2/0454

See application file for complete search history.

(56) References Cited

U.S. PATENT DOCUMENTS

| | | | | |
|---|---|---|---|---|
| 7,465,010 | B2 * | 12/2008 | Silverbrook | 347/17 |
| 8,113,616 | B2 * | 2/2012 | Hirota | 347/17 |
| 8,556,372 | B2 * | 10/2013 | Paschkewitz | 347/18 |
| 2010/0066785 | A1 | 3/2010 | Yamada et al. | |

FOREIGN PATENT DOCUMENTS

| | | |
|---|---|---|
| JP | 2003-220696 | 8/2003 |
| JP | 2010-094979 | 4/2010 |
| JP | 2012-056211 | 3/2012 |

* cited by examiner

*Primary Examiner* — Lamson Nguyen

(74) *Attorney, Agent, or Firm* — Frommer Lawrence & Haug LLP

(57) ABSTRACT

A liquid ejection apparatus includes a plurality of liquid ejection heads each comprising a channel member having a plurality of ejection openings, a plurality of channels communicated with the plurality of ejection openings, and a heat body, and a plurality of radiators each provided for each of the plurality of liquid ejection heads. The liquid ejection apparatus further includes a plurality of temperature sensors each provided for each of the plurality of liquid ejection heads and outputting a signal indicating a temperature of the channel member, a heat-resistance change device changing a heat resistance between one of the plurality of radiators and one of the plurality of liquid ejection heads corresponding to the one of the plurality of radiators, and a controller controlling the heat-resistance change device based on the signal outputted from at least one of the plurality of temperature sensors.

14 Claims, 10 Drawing Sheets

LIQUID EJECTION APPARATUS

CROSS REFERENCE TO RELATED APPLICATION

The present application claims priority from Japanese Patent Application No. 2013-074637, which was filed on Mar. 29, 2013, the disclosure of which is herein incorporated by reference to its entirety.

BACKGROUND OF THE INVENTION

1. Field of the Invention

The present invention relates to a liquid ejection apparatus which ejects liquid such as ink and so on.

2. Description of Related Art

In a liquid ejection apparatus, there is known a technique in which each of a plurality of liquid ejection heads is individually driven to eject liquids from ejection openings thereof such that an image is recorded on a recording medium In the liquid ejection apparatus, each head comprises a channel member in which a liquid chamber is formed, and a driver IC (a heat body). The driver IC is connected to the channel member through a wiring member and is thermally connected to the channel member.

SUMMARY OF THE INVENTION

In such a construction that the plurality of liquid ejection heads are used, each head has a different driving manner and the heat body of each head has a different heating value (amount). Since the heat body is thermally connected to the channel member, a temperature of the channel member of each head is different, and a difference in temperature between the channel members of the plurality of heads occurs. In this case, since the temperature of the liquid in the channel member of each head is different, so that a difference in ejection condition of the liquid between the heads occurs, and it is possible to deteriorate a recording quality.

It is therefore an object of the present invention to provide a liquid ejection apparatus capable of reducing a difference in temperature between channel members of a plurality of liquid ejection heads and restricting deterioration of a recording quality.

In order to achieve the above-mentioned object, according to the present invention, there is provided a liquid ejection apparatus comprising: a plurality of liquid ejection heads each comprising a channel member having a plurality of ejection openings through which liquid is ejected and a plurality of channels configured to be communicated with the plurality of ejection openings, and a heat body configured to be thermally connected to the channel member and configured to generate heat when energy is applied to liquid in the plurality of channels such that the liquid is ejected through the plurality of ejection openings; a plurality of radiators each provided for each of the plurality of liquid ejection heads; a plurality of temperature sensors each provided for each of the plurality of liquid ejection heads and each configured to output a signal indicating a temperature of the channel member of a corresponding one of the plurality of liquid ejection heads; a heat-resistance change device configured to change a heat resistance between one of the plurality of radiators and one of the plurality of liquid ejection heads corresponding to the one of the plurality of radiators; and a controller configured to control the heat-resistance change device based on the signal outputted from at least one of the plurality of temperature sensors.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Hereinafter, there will be described preferred embodiments of the invention with reference to the drawings.

Figure 1:
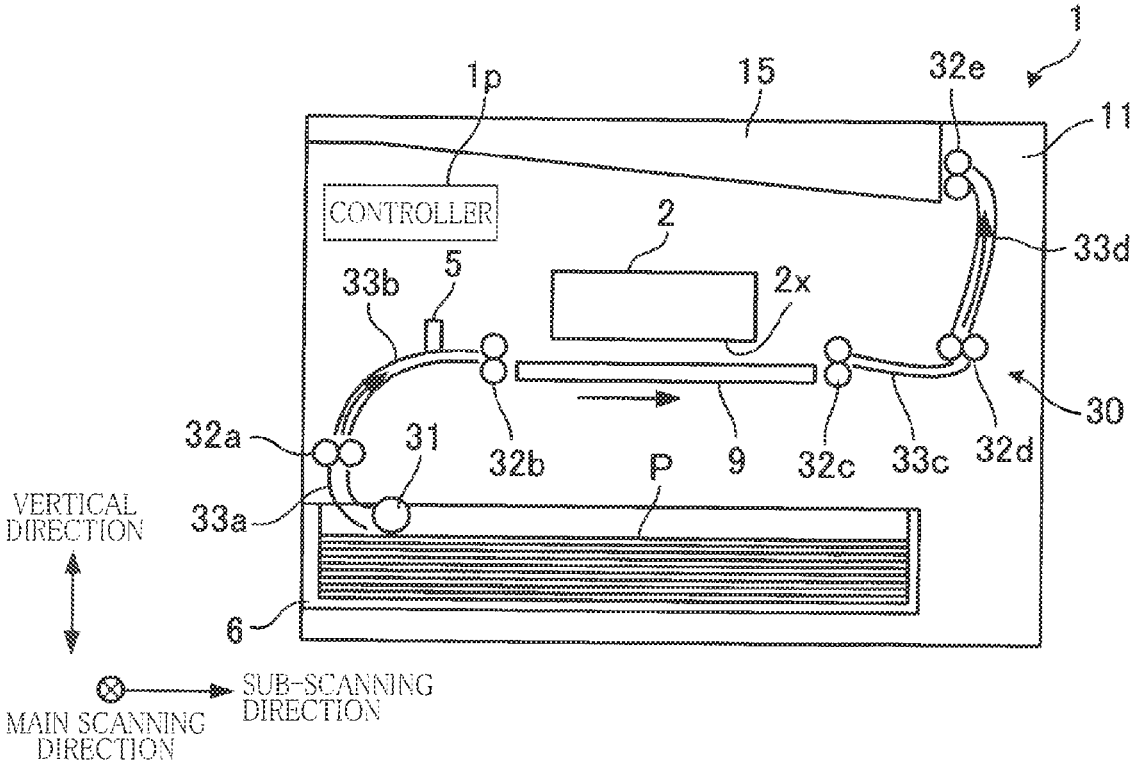
FIG. 1 is a schematic side view showing an internal structure of an inkjet printer as a first embodiment to which the present invention is applied.

First, there will be described an overall structure of an inkjet printer 1 as a first embodiment to which the present invention is applied with reference to FIG. 1.

The printer 1 includes a housing 11 having a rectangular parallelepiped shape. In an upper portion of a top panel of the housing 11, there is disposed a sheet-discharge portion 15. In an inner space of the housing 11, there are disposed an inkjet head 2, a platen 9, a sheet sensor 5, a sheet-supply tray 6, a conveying unit 30, a controller 1*p*, and so forth. In the inner space of the housing 11, a conveying path through which a sheet P is conveyed is formed along an arrow in FIG. 1 from the sheet-supply, tray 6 to the sheet-discharge portion 15. The printer I is a line-type printer in which recording is performed in a state in which the head 2 is fixed. In the housing 11, there are disposed four cartridges (not shown) with a predetermined relationship of arrangement. The four cartridges accommodate inks of yellow, cyan, magenta and black, respectively and are connected to the head 2 through tubes.

Figure 2:
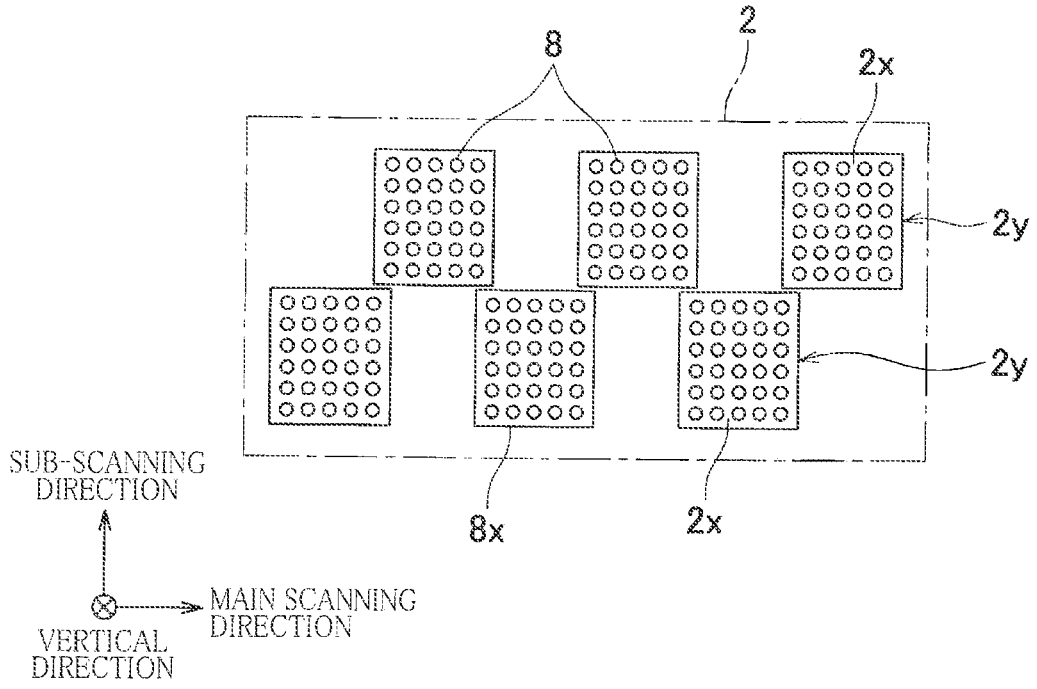
FIG. 2 is a plan view showing an inkjet head of the printer in FIG. 1.

As shown in FIG. 2, the head 2 includes six unit heads 2*y*. The six unit heads 2*y* are spaced apart from each other and are arranged in a zigzag manner (a staggered manner) and in two rows in a main scanning direction. Each unit head 2*y* is independently supported by the housing 11 through a support member or a holder (not shown). Each unit head 2 has, on a lower surface thereof, an ejection surface 2*x* in which a plurality of ejection openings 3 are formed. In each unit head 2*y*, the plurality of ejection openings 8 constitute one ejection opening group 8*x*. Each of a plurality of ejection opening groups 8*x* is constituted by six ejection-opening rows. Each ejection-opening row is constituted by a plurality of ejection openings 8 that are arranged in the main scanning direction. The six ejection-opening rows are arranged in a sub-scanning direction. Each ejection opening group 8*x* has the ejection-opening row of yellow, the ejection-opening row of cyan, the ejection-opening row of magenta and the three ejection-opening rows of black in an order from an upstream side in a conveying direction of a sheet P by the conveying unit 30 (hereinafter, simply referred to as "a conveying direction"). The black ink is ejected from the three ejection rows of black that are located at a downstream side in the conveying direction.

The platen 9 is a fiat plate member and is opposed to the head 2 in a vertical direction (a direction perpendicular to the main scanning direction and the sub-scanning direction). There is formed a predetermined space suitable for recording (image forming) between an upper surface of the platen 9 and the ejection surface 2*x* of each of the unit heads 2*y*.

The sheet sensor 5 is disposed at an upstream side of the head 2 in the conveying direction. The sheet sensor 5 detects an (leading) end of the sheet P and outputs detection signals to the controller 1*p*.

The sheet-supply tray 6 has such a box-like structure that an upper surface thereof opens, and is detachably attached to the housing 11. The sheet-supply tray 6 is capable of accommodating a plurality of sheets P.

The conveying unit 30 includes a pickup roller 31, pairs of nip rollers 32*a*, 32*b*, 32*e*, 32*d*, 32*e*, and guides 33*a*, 33*b*, 33*c*, 33*d*. The pickup roller 31 is rotated by driving of a sheet-supply motor 6M (shown in FIG. 6) under the control of the controller 1*p* so as to supply an uppermost one of the sheets P in the sheet-supply tray 6. The pairs of nip rollers 32*a* through 32*e* are disposed in this order from the upstream side in the conveying direction along the conveying path. One of each of the pairs of nip rollers 32*a* through 32*e* is a driving roller that is rotated by driving of a conveying motor 7M (shown in FIG. 6) under the control of the controller 1*p*. The other of each of the pairs of nip rollers 32*a* through 32*e* is a driven roller that is rotated with the rotation of the driving roller. The guides 33*a* through 33*d* are disposed in this order from the upstream side in the conveying direction along the conveying path and each of the guides 33*a* through 33*d* and each of the pairs of nip rollers 32*a* through 32*e* are alternately arranged. Each of the guides 33*a* through 33*d* is formed of a pair of plates that are opposed to each other.

Under the control of the controller 1*p*, the sheet P that is supplied from the sheet-supply tray 6 by rotating of the pickup roller 31 is nipped by the pairs of nip rollers 32*a* through 32*e* and is passed through a space between the pair of plates of the guides 33*a* through 33*d* to be conveyed in the conveying direction. When the sheet P passes right below the head 2, supported by the upper surface of the platen 9, the controller 1*p* controls such that each color of ink is ejected to an upper surface of the sheet P from the ejection openings 8 (shown in FIG. 2). Ejecting of ink from the ejection openings 8 is performed based on the detection signal outputted from the sheet sensor 5. The sheet P on which an image has been formed is discharged onto the sheet-discharge portion 15 through an opening that is disposed in an upper portion of the housing 11.

Figure 6:
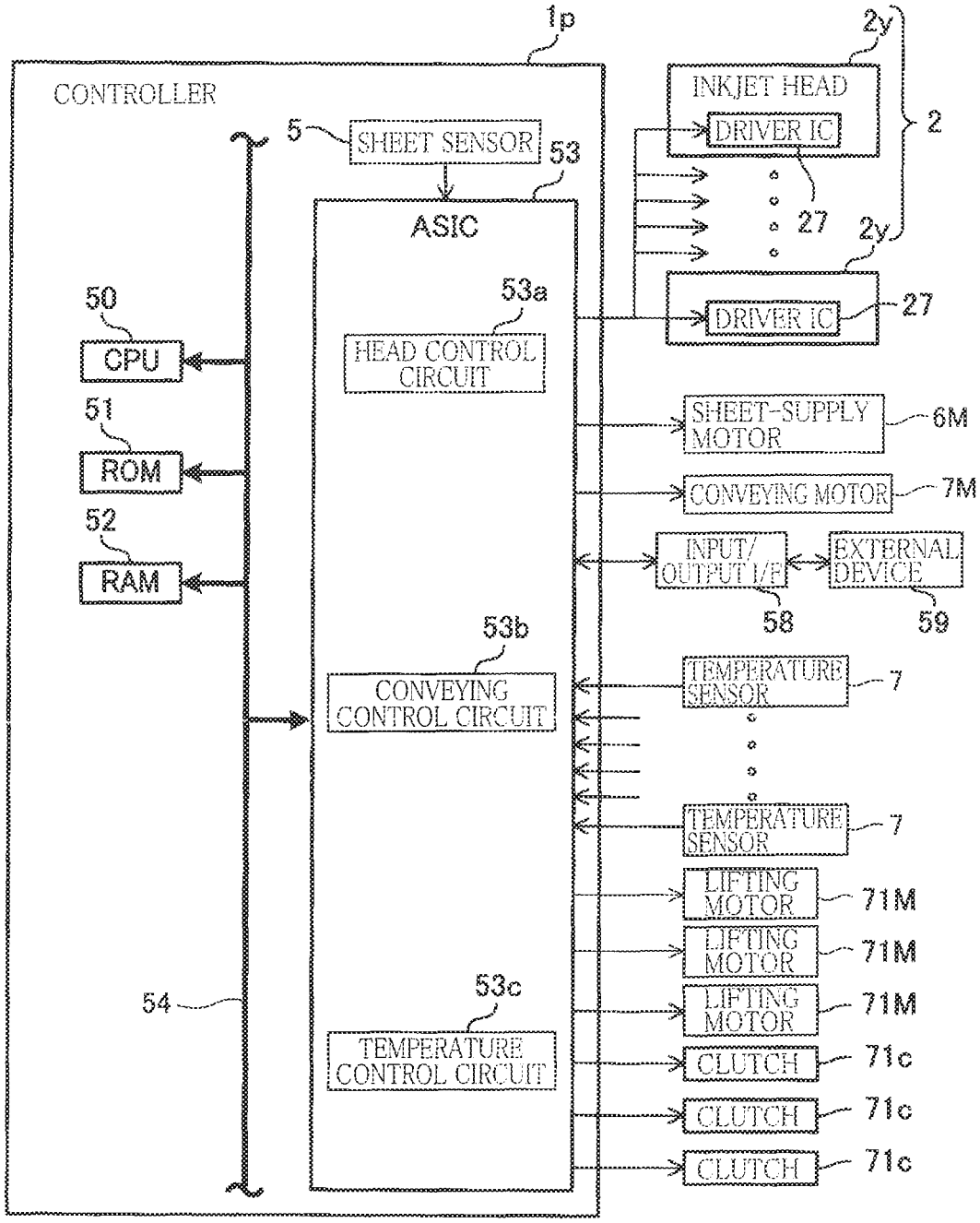
FIG. 6 is a block diagram showing an electrical structure of the printer.

As shown in FIG. 6, the controller 1*p* includes a CPU (Central Processing Unit) 50, a ROM (Read Only Memory) 51, a RAM (Random Access Memory) 52, an ASIC (Application Specific Integrated Circuit) 53, a path 54, and so on. The ROM 51 stores programs that are executed by the CPU 50, various fixed data, and so forth. The RAM 52 temporarily stores data (image data and so on) necessary when the programs are executed. The ASIC 53 includes a head control circuit 53*a*, a conveying control circuit 53*b*, and a temperature control circuit 53*c*. Further, the ASIC 53 is connected to an external device 59 such as a PC (Personal Computer) and so on so as to be capable of transmitting and receiving data to and from the external device 59 through an Input/Output I/F (Interface) 58. The head control circuit 53*a* controls a driver IC 27 based on recording data inputted from the external device 59. The conveying control circuit 53*b* controls the sheet-supply motor 6M and the conveying motor 7M based on the recording data inputted from the external device 59. As described later, the temperature control circuit 53*c*, based on a signal outputted from a temperature sensor 7, controls the driver IC 27 (an example of a drive circuit) such that a frequency of a non-ejection flushing increases, and controls a lifting motor 71M and a clutch 71*c* such that a heat resistance of a heat sink 40 (an example of a radiator) with respect to the head 2 changes.

In the present embodiment, one CPU 50 executes processings for various controls, but the present invention is not limited to this embodiment. For example, a plurality of CPUs may execute the processings for various controls, the ASIC may execute the processings for various controls, one or a plurality of CPUs and one or a plurality of ASICs may cooperate with each other to execute the processings for various controls.

Figure 3:
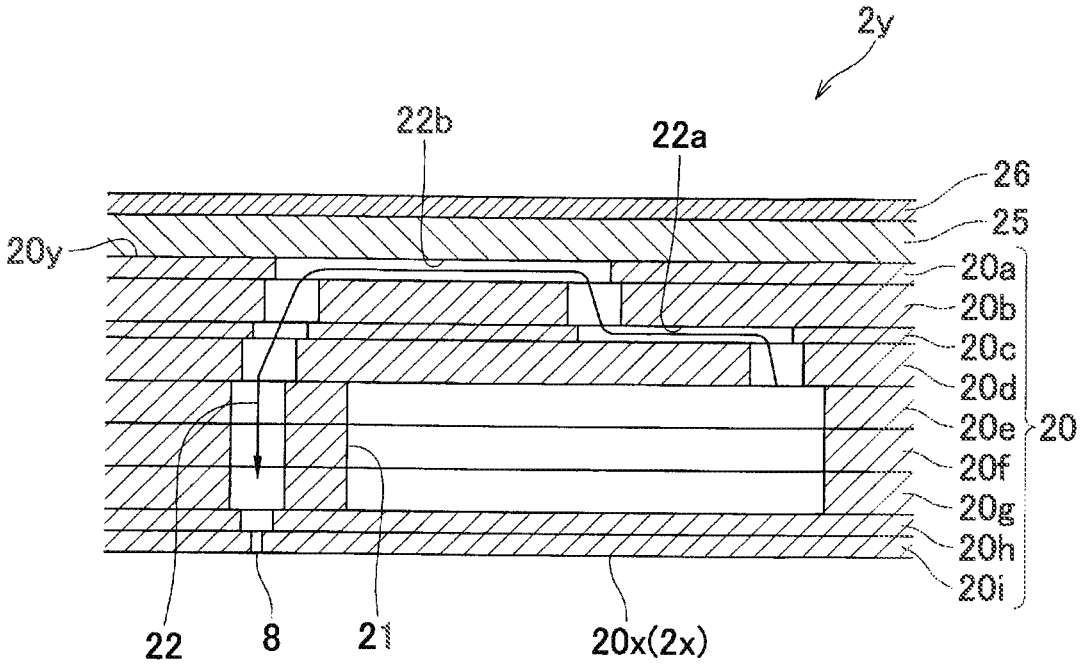
FIG. 3 is a partial cross-sectional view showing the head.

Hereinafter, the head 2 will be described in detail with reference to FIG. 3.

The six unit heads 2*y* are the same in structure and each of the six unit heads 2*y* comprises a channel member 20, an actuator unit 25, and two COFs (Chip On Film) 26.

The channel member 20 has a laminar structure in which rectangular metallic plates 20*a*, 20*b*, 20*c*, 20*d*, 20*e*, 20*f*, 20*g*, 20*h*, 20*i* of generally the same size are adhered to each other. In the channel member 20, there is formed a channel Which extends to each of the plurality of ejection openings 8. The channel includes a common channel 21 that are common to all the ejection openings 8 formed in the channel member 20 and a plurality of individual channels 22 that are disposed corresponding to the plurality of ejection openings 8. Each of the plurality of individual channels 22 is a channel which extends from an outlet of the common channel 21 to a corresponding one of the plurality of ejection openings 8 through an aperture 22*a* and a pressure chamber 22*h*. The pressure chamber 22*b* opens at an upper surface 20*y* of the channel member 20, and each of the plurality of ejection openings 8 opens at a lower surface 20*x* of the channel member 20. The lower surface 20*x* is the ejection surface 2*x*. A plurality of pressure chambers 22*b* are, similar to the ejection opening group 8*x*, disposed in a rectangular area of the channel member 20 and constitute one pressure chamber group.

The actuator unit 25 is fixed to an area on the upper surface 20*y* of the channel member 20 which covers the plurality of pressure chambers 22*b* that constitutes the pressure chamber group. The actuator unit 25 includes a plurality of piezoelectric actuators that are disposed corresponding to the plurality of pressure chambers 22*b*.

Figure 5A:
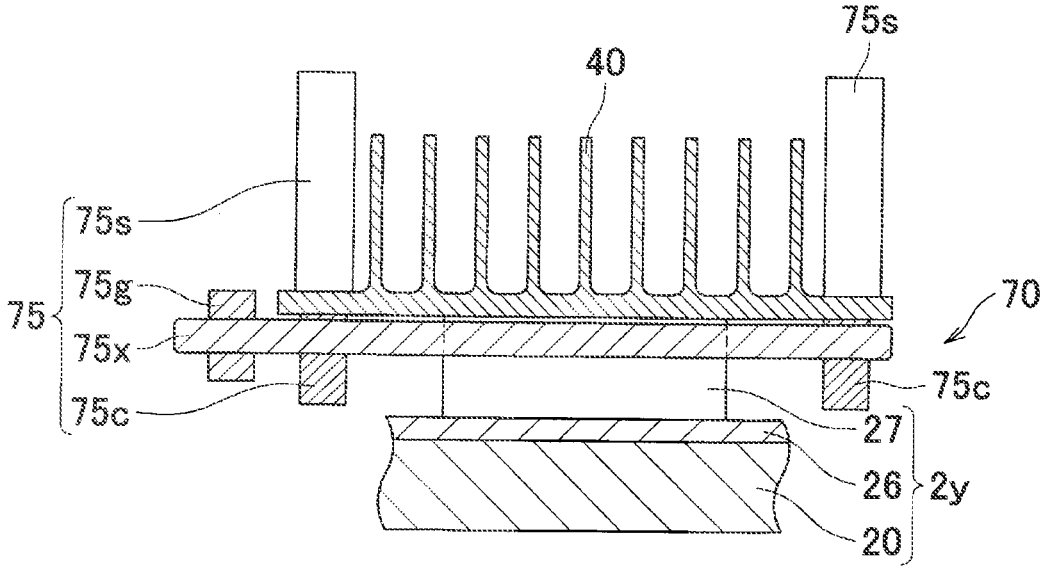
FIG. 5A is a cross-sectional view taken along a line V-V in FIG. 4A and a view showing a state in which the heat sink is positioned at a contact position (a cooling mode)
Figure 5B:
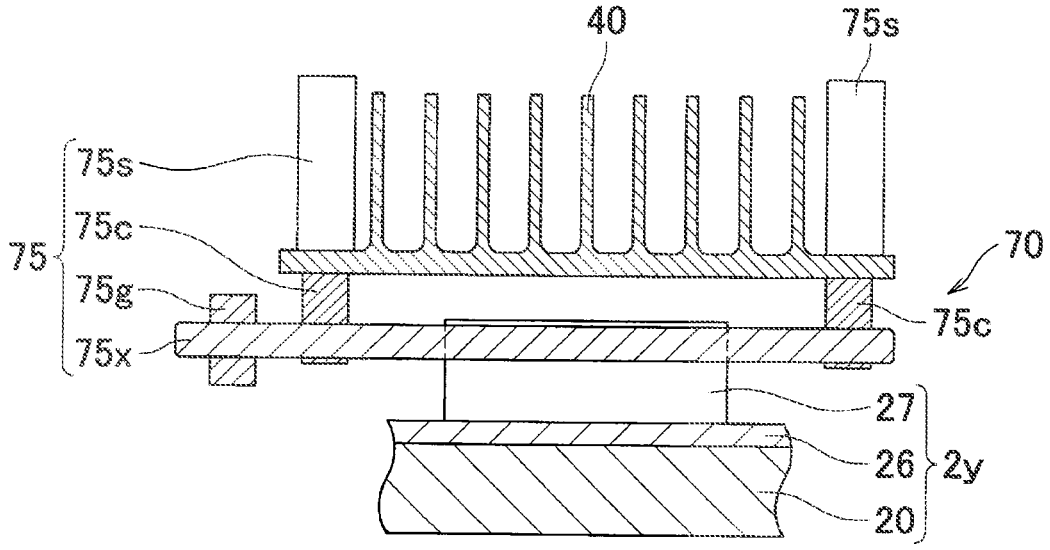
FIG. 5B is a cross-sectional view taken along a line V-V in FIG. 4A and a view showing a state in which the heat sink is positioned at the distant position (a heating mode)

Each of the two COFs 26 corresponds to a color ink or a black ink, and the two COFs 26 are fixed to an upper surface of the actuator unit 25. Each of the two COFs 26 is a flat wiring board having a plurality of wires, and the driver IC 27 (shown in FIGS. 5 and 6) is mounted on each of the two COFs 26. By the plurality of wires of each of the two COFs 26, an output terminal of the driver IC 27 is connected to an electrode of the piezoelectric actuator. The two driver ICs 27 each of which is mounted on a corresponding one of the two COFs 26 are capable of moving toward and away from a lower surface of a base portion of the heat sink 40 and are symmetrically arranged to the lower surface of the base portion of the heat sink 40.

Under the control of the controller 1*p*, by applying of a predetermined potential to each of the plurality of piezoelectric actuators from the driver IC 27, the plurality of piezoelectric actuators are selectively driven. Accordingly, energy for ejection of ink in the pressure chamber 22*b* from the ejection opening 8 is applied to the ink in the pressure chamber 22*b*, and the ink is thus ejected from the ejection opening 8.

When the piezoelectric actuator is driven, the driver IC 27 generates heat. The heat is transmitted to the channel member 20 through the COFs 26, whether ink is ejected or not.

Therefore, for each of the six unit heads 2*y*, there are disposed a heat sink 40 (shown in FIGS. 4 and 5) for radiation (emission) of heat and the temperature sensor 7 (shown in FIG. 6) which outputs a signal indicating a temperature of the channel member 20.

As shown in FIGS. 4A and 4B and FIGS. 5A and 5B, the heat sink 40 comprises the base portion and a plurality of fins which extend from the base portion. The base portion and the plurality of fins of the heat sink 40 are integrally formed. The lower surface of the base portion of the heat sink 40 is contactable with the driver IC 27. Each of the plurality of fins of the heat sink 40 is a plate extending in the sub-scanning direction and the plurality of fins are arranged in the main scanning direction. The plurality of fins are arranged in the above-described manner such that the plurality of fins can effectively catch a current of air (an airflow) in the sub-scanning direction.

The heat sink 40 is movable up and down by driving of a heat-sink lifting mechanism 70 (an example of a heat-resistance change device). Therefore, each heat sink 40 moves relatively to a corresponding one of the unit heads 2*y* such that the heat sink 40 is selectively positioned at a contact position (a position shown in FIG. 5A) at which the heat sink 40 is held in contact with the driver IC 27 of the corresponding one of the unit heads 2*y*, and at a distant position (a position shown in FIG. 5B) at which the heat sink 40 is spaced apart from the driver IC 27 of the corresponding on of the unit heads 2*y*. Depending on a positional relationship between the heat sink 40 and the driver IC 27, a heat resistance of the heat sink 40 with respect to the unit head 2*y* varies. The heat resistance of the heat sink 40 is greater when the heat sink 40 is positioned at the distant position than when the heat sink 40 is positioned at the contact position. The unit head 2*y* is cooled when the heat sink 40 is positioned at the contact position and the heat is radiated through the heat sink 40 (a cooling mode). The unit head 2*y* is heated by the heat of the driver IC 27 when the heat sink 40 is positioned at the distant position and the heat is not radiated through the heat sink 40 (a heating mode). In other words, at the contact position where the heat resistance is low; the heat sink 40 is in contact with the driver IC 27 such that the unit head 2*y* is cooled (the cooling mode). At the distant position where the heat resistance is large, the heat sink 40 is spaced apart from the driver IC 27 such that the unit head 2*y* is heated by the driver IC 27 (the heating mode). Normally (except a case of moving to the heating mode in S9 described later), all of the heat sinks 40 are positioned at the contact position, so that all of the unit heads 2*y* stay in the cooling mode.

Figure 4A:
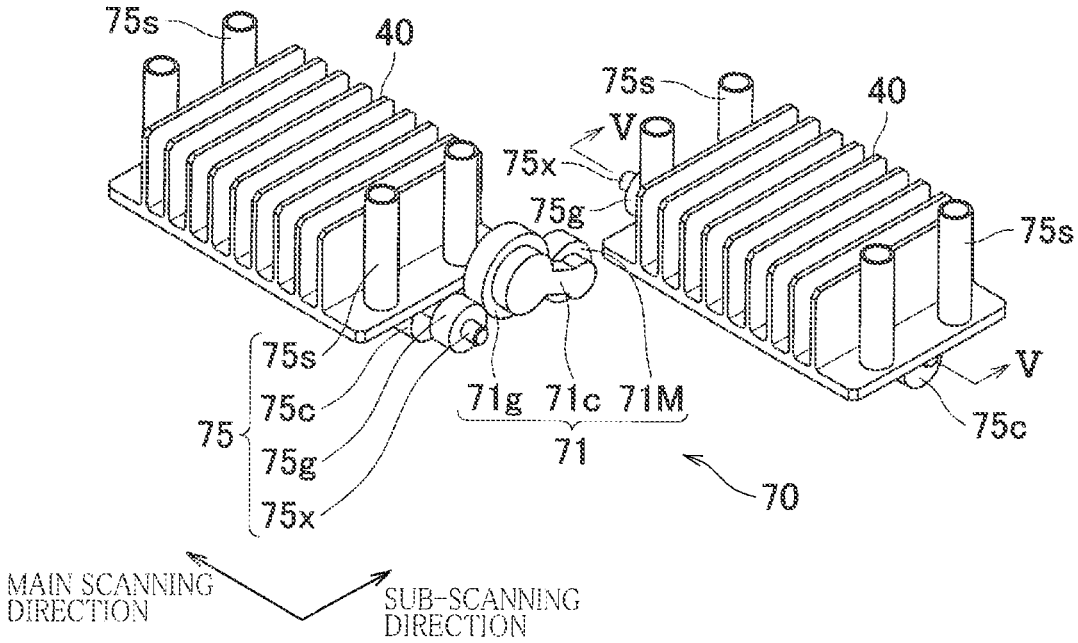
FIG. 4A is a perspective view from an upper portion showing a heat sink and a heat-sink lifting mechanism.
Figure 4B:
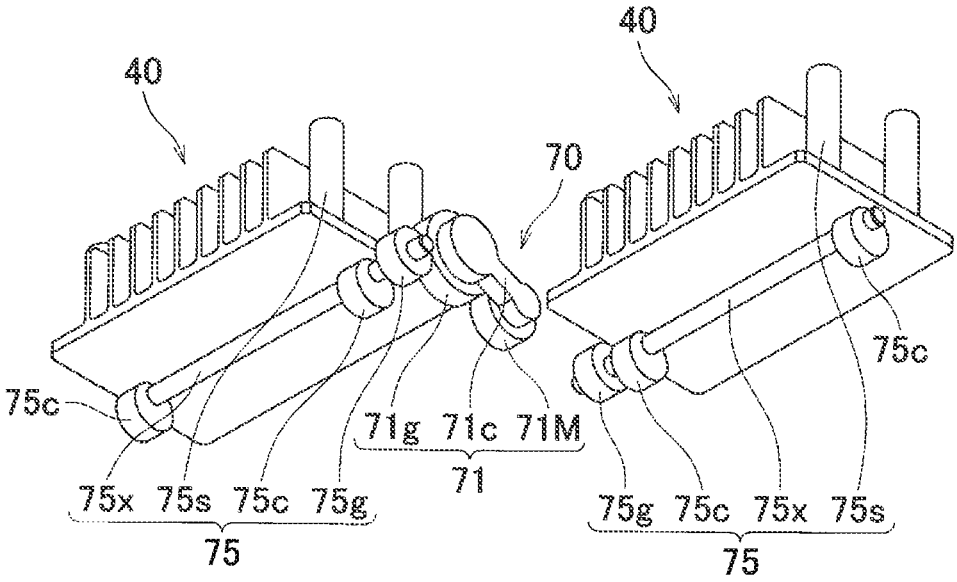
FIG. 4B is a perspective view from a lower portion showing the heat sink and the heat-sink lifting mechanism.

As shown in FIGS. 4A and 4B, one heat-sink lifting mechanism 70 is disposed for two of the six heat sinks 40 adjacent to each other. That is, in total, three heat-sink lifting mechanisms 70 are disposed for the six heat sinks 40.

The heat-sink lifting mechanism 70 comprises a common portion 71 which is common to two of the six heat sinks 40, and an individual portion 75 which is disposed for each of the six heat sinks 40. The common portion 71 comprises a lifting motor 71M, a gear 71*g* which meshes with the lifting motor 71M, and a clutch 71*c* which connects a rotation shaft of the lifting motor 71M to a rotation shaft of the gear 71*g* so as to be freely rotatable. The individual portion 75 comprises a gear 75*g* capable of meshing with the gear 71*g*, two cams 75*c* which are disposed to be opposed to the lower surface of the base portion of the heat sink 40, a shaft 75*x* which functions as a rotation axis of the gear 75*g* and the two cams 75*c*, and four springs 75*s* which are disposed on an upper surface of the base portion of the heat sink 40. The four springs 75*s* are symmetrically arranged with respect to the shaft 75*x* and each of the four springs 75*s* applies a downward force to the heat sink 40.

The clutch 71*c*, depending on a rotation direction of the lifting motor 71M, switches the gear to be meshed with the gear 71*g* between the gear 75*g* of one individual portion 75 and the gear 75*g* of the other individual portion 75. When the lifting motor 71M rotates, a rotation force is applied to the rotation shaft of the gear 71*g* so as to rotate the rotation shaft of the gear 71*g* about the rotation axis of the lifting motor 71M in a rotation direction of the clutch 71*c* corresponding to the rotation direction of the lifting motor 71M. Accordingly; the gear 71*g* meshes with the gear 75*g* of the one individual portion 75 which is located on a downstream side in the rotation direction of the clutch 71*c*. In other words, the clutch 71*c* is selectively positioned at a first position, at which, when the lifting motor 71 M rotates in a forward direction, the gear 71*g* meshes with the gear 75*g* of the one individual portion 75, and at a second position, at which, when the lifting motor 71M rotates in a reverse direction, the gear 71*g* meshes with the gear 75*g* of the other individual portion 75. When the lifting motor 71M is driven in a state in which the clutch 71*c* is positioned at the first position or at the second position, the rotation of the lifting motor 71M is transmitted to the gear 71*g* of the one individual portion 75 or to the other individual portion 75 through the gear 71*g*, and the two earns 75*c* are rotated with the rotation of the gear 75*g*. The heat sink 40 is thus moved up and down. The four springs 75*c* apply the force to the heat sink 40 in an entire area in which the heat sink 40 is movable. When the heat sink 40 is positioned at the contact position (a position shown in FIG. 5A), the two cams 75*c* are slightly spaced apart from the lower surface of the base portion of the heat sink 40 such that the driver IC 27 receives the force of the springs 75*s*, When the heat sink 40 is positioned at the distant position (a position shown in FIG. 5B), the cams 75*c* are in contact with the lower surface of the base portion of the heat sink 40 such that the cams 75*c* receives the force of the springs 75*s*.

It takes a few seconds from a point in time when one of the two heat sinks 40 adjacent to each other starts to move up or down to a point in time when the other of the two heat sinks 40 starts to move up or down.

Figure 7:
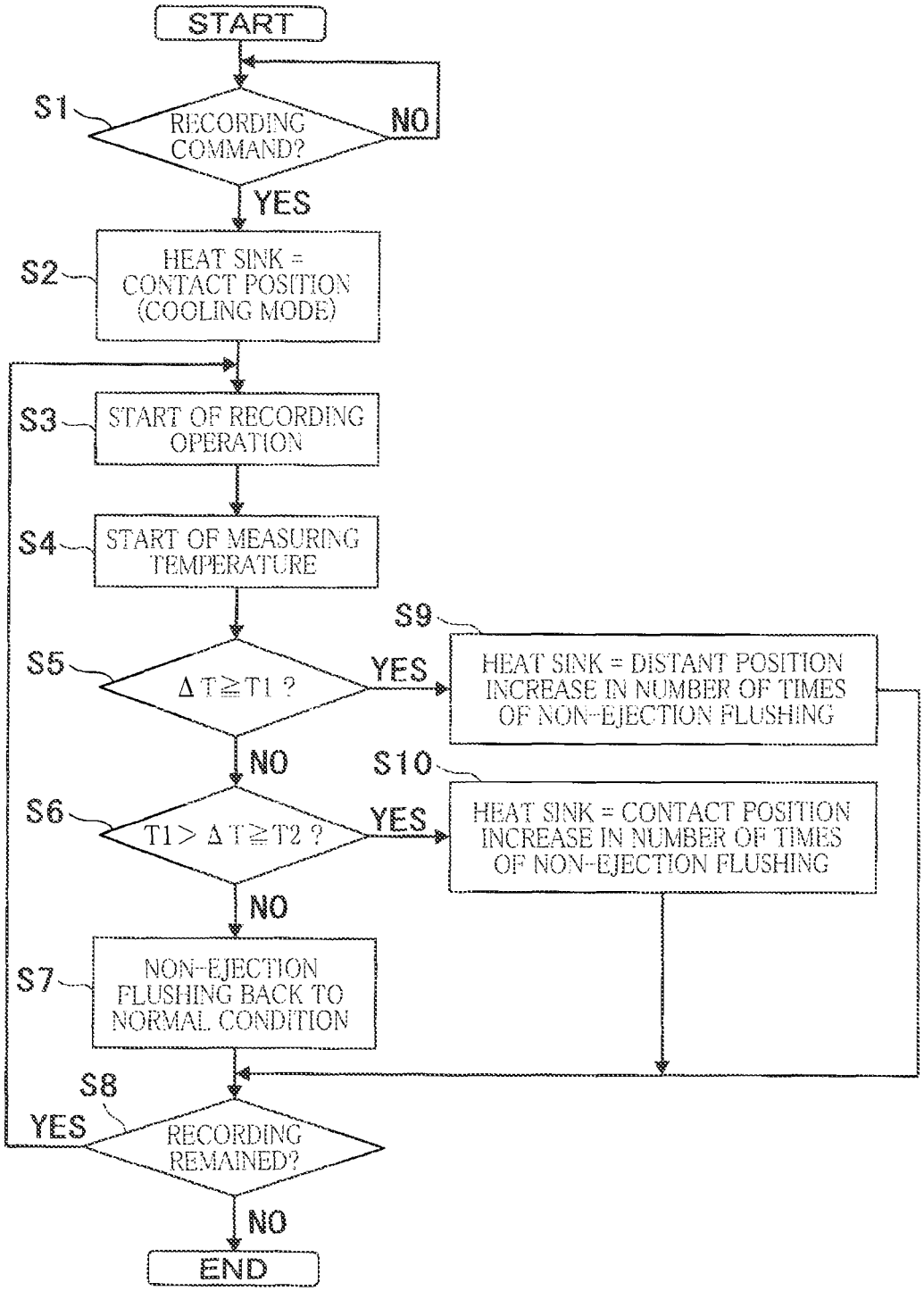
FIG. 7 is a flow chart showing an operation executed by a controller of the printer.

Hereinafter, operations executed by the controller 1*p* will be described with reference to FIG. 7.

The controller 1*p* performs a control for non-ejection flushing in order to prevent a viscosity of ink. The non-ejection flushing is an operation in which a meniscus of ink formed in the ejection opening 8 is oscillated without ejection of ink from the ejection opening 8. When the non-ejection flushing is performed, the piezoelectric actuator is driven by applying of a pulse voltage. The non-ejection flushing is performed within a period in which the sheet P is not opposed to the ejection surface 2*x* during a conveying operation in which the sheet P is conveyed, within a non-ejection period during a recording operation, and so forth.

The controller 1*p* first judges whether a recording command is received (step S1; hereinafter, "step" will be omitted). When the recording command is not received (S1: NO), the controller 1*p* repeats the processing. When the controller 1*p* receives the recording command (S1: YES), the controller 1*p* controls the lifting motor 71M and the clutch 71*c* to move all of the heat sinks 40 to the contact position such that all of the unit heads 2*y* become in the cooling mode (S2).

Following S2, the controller 1*p* controls the unit heads 2*y* and the conveying unit 30 to start a recording operation based on the recording command (S3). Specifically, the head control circuit 53*a* controls the driver ICs 27 based on recording data included in the recording command The conveying control circuit 53*b* controls the sheet-supply motor 6M and the conveying motor 7M based on the recording data included in the recording command. Further, the head control circuit 53*a* controls the driver ICs 27 such that, in each of the ejection openings 8, the non-ejection flushing is performed in a normal condition. The normal condition is a preset condition regarding a number of pulse, a number of oscillation (vibration), a timing of applying a pulse voltage, and so on.

Following S3, the controller 1*p* starts to measure a temperature of the channel members 20 by each of the temperature sensors 7 (S4).

Following S4, the temperature control circuit 53*c* judges, based on a signal outputted from the temperature sensor 7, whether ΔT (a difference in temperature between two of the six unit heads 2*y*) is equal to or greater than a T1 (a first predetermined value) (S5). When ΔT is smaller than T1, i.e., ΔT<T1 (S5: NO), the temperature control circuit 53*c* moves the processing to S6. When ΔT is equal to or greater than T1, i,e., ΔT≥T1 (S5: YES), the temperature control circuit 53*c* moves the processing to S9.

In S6, the temperature control circuit 53*c* judges whether ΔT is smaller than T1, and ΔT is equal to or greater than T2 (a threshold temperature: a second predetermined value). When the temperature control circuit 53*c* judges that T1>ΔT≥T2 (S6: YES), the temperature control circuit 53*c* moves the processing to S10. When the temperature control circuit 53*c* judges that ΔT<T1 (S6: NO), the temperature control circuit 53*c* moves the processing to S7.

In S7, the controller 1*p* controls a condition of the non-ejection flushing to return to the normal condition, which means that the recording operation is performed in the cooling mode. Then, the controller 1*p* moves the processing to S8.

In S8, the controller 1*p* judges whether the recording operation based on the recording command that was received in S1 is completed. When the recording operation is completed, i.e., there are no sheets to be recorded remaining (S8: NO), the controller 1*p* ends execution of the routine. When the recording operation is not completed, i.e., there are some sheets to be recorded remaining (S8: YES), the controller 1*p* returns the processing to S3.

In S9, the temperature control circuit 53*c* moves the heat sinks 40 to the distant position and sets a frequency (a number of times) of the non-ejection flushing to be increased. In other words, the number of pulses applied to the plurality of piezoelectric actuators of the unit head 2*y* in a unit time is increased. In S9, the heat sinks 40 that are moved to the distant position include at least one of the heat sinks 40 corresponding to a lower one in temperature of two unit heads 2*y* which meet ΔT≥T1 (in a case where a plurality of pairs of two unit heads 2*y* which meet ΔT≥T1 exist, a lower one in temperature of two unit heads 2*y* whose difference in temperature ΔT is the greatest is selected). Further, the frequency of the non-ejection flushing is increased for at least the lower one in temperature of two unit heads 2*y* which meet ΔT≥T1. For the highest one in temperature of the six unit heads 2*y*, the non-ejection flushing is kept in the normal condition. By moving of the heat sink 40 to the distant position, a heat resistance of the heat sink 40 relative to the corresponding unit head 2*y* increases, and by increasing in the frequency of the non-ejection flushing, a heat value (amount) of each of the driver ICs 27 increases.

A state in S9, that is, a state in which the heat sink 40 is positioned at the distant position and the frequency of the non-ejection flushing is increased is referred to as a heating mode.

After S9, the controller 1*p* moves the processing to S8. Accordingly, the recording operation continues under the condition in which the heat value is greater and the heat resistance is greater. Then, when ΔT becomes smaller, in S10, the heat sink 40 is moved from the distant position to the contact position.

In S10, the temperature control circuit 53*c* sets the frequency of the non-ejection flushing to be increased. The increase in the frequency of the non-ejection flushing in S10 is the same as described in S9. That is, the frequency of the non-ejection flushing is increased for at least the lower one in temperature of two unit heads 2*y* which meet ΔT≥T1. For the highest one in temperature of the six unit heads 2*y*, the non-ejection flushing is kept in the normal condition. Further, for the unit head 2*y* in which the corresponding heat sink 40 is positioned at the distant position, the heat sink 40 is moved from the distant position to the contact position.

A state in S10, that is, a state in which the heat sink 40 is positioned at the contact position and the frequency of the non-ejection flushing is increased is referred to as a semi-heating mode.

Following S10, the controller 1*p* moves the processing to S8. Accordingly, the recording operation continues under the condition in which the heat value is greater. Then, when ΔT becomes smaller, in S7, the condition of the non-ejection flushing is returned to the normal condition such that the unit head 2*y* is switched to the cooling mode. On the other hand, when ΔT becomes greater, in S9, the heat sink 40 is moved from the contact position to the distant position such that the corresponding unit head 2*y* is switched to the heating mode.

As described above, in the present embodiment, for each of the unit heads 2*y*, the heat resistance of the heat sink 40 is changed based on the temperature of the channel member 20, so that an amount of the heat emitted through the heat sink 40 can be adjusted. Therefore, the difference in temperature ΔT between two channel members 20 decreases, and deterioration of a recording quality can be restrained.

When the temperature control circuit 53*c* judges that the difference in temperature between the two channel members 20 ΔT is equal to or greater than T1 (ΔT≥T1) (S5: YES), the temperature control circuit 53*c* controls the heat-sink lifting mechanism 70 such that at least the heat resistance of the heat sink 40 corresponding to the lowest one in temperature of the channel members 20 becomes greater than the heat resistance of the heat sink 40 corresponding to the highest one in temperature of the channel members 20. Thus, the temperature of each of the channel members 20 is uniformized to a higher side in temperature, so that any special elements for cooling except the heat sinks 40 is unnecessary, leading to simplifying of the structure.

When the controller 1*p* judges that ΔT<T1 (S5: NO), the controller 1*p* controls the heat-sink lifting mechanism 70 such that the heat resistance of all of the heat sinks 40 becomes the smallest value within a variable range of the heat resistance, i.e., such that all of the heat sinks 40 are kept at the contact position. When the controller 1*p* judges that ΔT≥T1 (S5: YES), the controller 1*p* controls the heat-sink lifting mechanism 70 such that at least the heat resistance of the heat sink 40 corresponding to the lowest one in temperature of the channel members 20 becomes greater than the smallest value. In this case, the difference in temperature ΔT between the two channel members 20 can be more effectively reduced.

When the controller 1*p* judges that ΔT≥T1 (S5: YES), the controller 1*p* controls the driver ICs 27 such that at least the frequency of the non-ejection flushing in the lowest one in temperature of the channel members 20 becomes greater than the frequency of the non-ejection flushing in the highest one in temperature of the channel members 20 (S10). In this ease, before the heat resistance is changed, the non-ejection flushing is performed with high accuracy, so that the temperature of the channel members 20 is increased, leading to reduction of the difference in temperature ΔT between the two channel members 20.

Further, during a period which starts at a point in time when the controller 1*p* moves the heat sink 40 up in 59 and ends at a point in time when T1>ΔT T is met or the recording operation is completed, the controller 1*p* controls such that, in a state in which the heat resistance of the heat sink 40 is kept large, at least the frequency of the non-ejection flushing in the lowest one in temperature of the channel members 20 is kept greater than the frequency of the non-ejection flushing in the highest one in temperature of the channel members 20. In a case where the non-ejection flushing is performed in a state in which the heat resistance of the heat sink 40 is small, due to the heat radiation from the heat sink 40, the temperature of the channel member 20 cannot be effectively increased. In the present embodiment, the non-ejection flushing is performed with high accuracy in a state in which the heat resistance of the heat sink 40 is large (in a state in which the heat sink 40 is positioned at the distant position), so that useless consumption of electric power and thermal energy can be restrained and the temperature of each of the channel members 20 can be effectively increased.

The controller 1*p* controls the heat sink lifting mechanism 70 such that each of the six heat sinks 49 is selectively positioned at the contact position or at the distant position. In this embodiment, by relatively simple control of switching of the position of the heat sinks 40, the difference in temperature between the two channel members 20 can be reduced.

Each of the six heat sinks 40 is, at the contact position, in contact with the driver ICs 27 of the corresponding one of the six unit heads 2*y*. Therefore, the heat radiation through the heat sinks 40 can be effectively performed.

In a case where, when the position of the heat sink 40 is switched, the whole unit head 2*y* is moved, it is difficult to reproduce the position of the unit head 2*y* and there is possibility that a failure in recording occurs. On the other hand, the present embodiment adopts such a structure that the heat sink 40 is moved by the heat-sink lifting mechanism 70, so that the above-described problem can be reduced and a relative movement of the heat sink 40 and the unit head 2*y* can be realized.

Hereinafter, there will be described an inkjet printer as a second embodiment to which the present invention is applied with reference to FIGS. 8A through 8C and 9.

The inkjet printer as the second embodiment is different from the printer 1 as the first embodiment in a structure of a heat sink and in operations executed by a controller (a processing executed by the temperature control circuit 53*c*), and the other structures of the printer as the second embodiment are the identical with those of the printer 1 as the first embodiment.

Figure 8A:
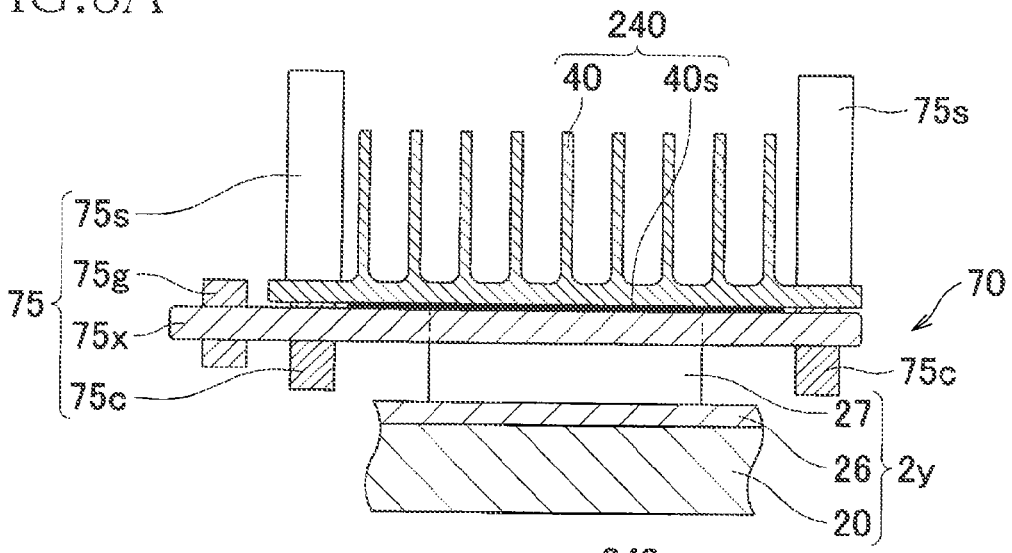
FIG. 8A is a cross-sectional view corresponding to FIGS. 5A and 5B showing an inkjet printer as a second embodiment to which the present invention is applied and showing a state in which a heat sink is positioned at a first contact position (a cooling mode)
Figure 8B:
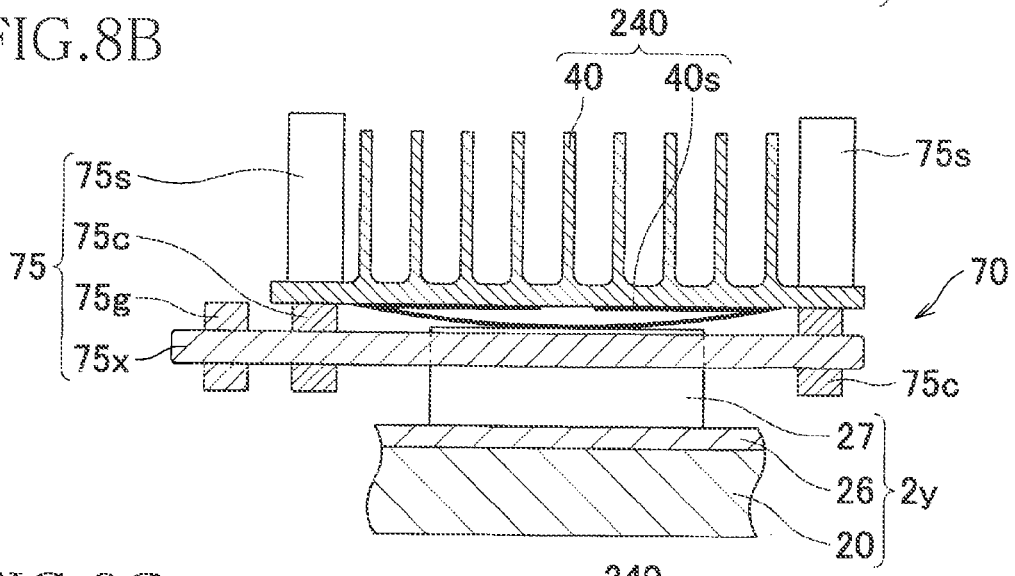
FIG. 8B is a cross-sectional view corresponding to FIGS. 5A and 5B showing the inkjet printer as the second embodiment and showing a state in which the heat sink is positioned at a second contact position (an intermediate mode)
Figure 8C:
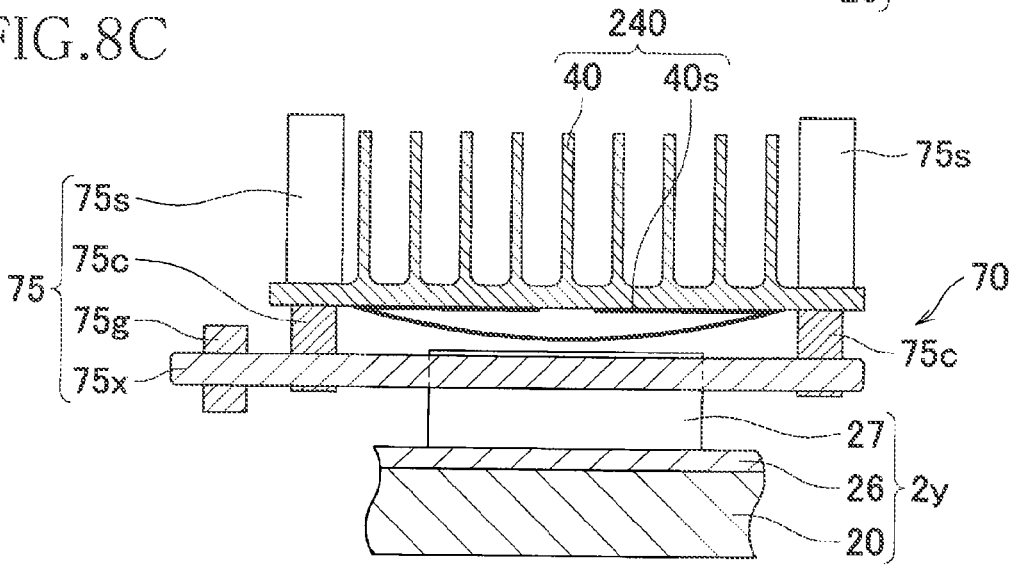
FIG. 8C is a cross-sectional view corresponding to FIGS. 5A and 5B showing the inkjet printer as the second embodiment and showing a state in which the heat sink is positioned at the distant position (a heating mode)

In the second embodiment, as Shown in FIGS. 8A through 8C, a heat sink 240 disposed corresponding to each of the six unit heads 2*y* comprises, in addition to the heat sink 40 in the first embodiment, a leaf spring 40*s* which is disposed on a lower surface (a surface opposed to the unit head 2*y*) of the base portion of the heat sink 40. The leaf spring 40*s* is constructed such that, depending on a distance between the leaf spring 40*s* and a corresponding one of the unit heads 2*y*, a contact area of the leaf spring 40*s* with the corresponding one of the unit heads 2*y* is variable. By lifting of the heat sink 240 by driving of the heat-sink lifting mechanism 70, the contact area of the leaf spring 40*s* with the corresponding one of the unit heads 2*y* is changed. The heat resistance of the heat sink 240 to the corresponding one of the unit heads 2*y* is changed depending on changing of the contact area of the leaf spring 40*s* with the corresponding one of the unit heads 2*y*.

The heat sink 240 is lifted by the heat-sink lifting mechanism 70 so as to be selectively positioned at a first contact position (a position shown in FIG. 8A), at a second contact position (a position shown in FIG. 8B), and at the distant position (a position shown in FIG. 8C). The first contact position is a position at which, among three positions of the first contact position, the second contact position and the distant position, the contact area of the leaf spring 40*s* with the unit head 2*y* is the largest, the heat resistance of the heat sink 240 is the smallest, and a cooling power of the heat sink 240 is the greatest (a cooling mode). The second contact position is a position at which the contact area of the leaf spring 40*s* with the unit head 2*y* is smaller than that at the first contact position, the heat resistance of the heat sink 240 is greater than that at the first contact position, and the cooling power of the heat sink 240 is smaller than that at the first contact position (an intermediate mode). The distant position is a position at which the leaf spring 40*s* is spaced apart from the unit head 2*y*, and a position at which, among the three positions, the heat resistance of the heat sink 240 is the greatest, the cooling power of the heat sink 240 is the smallest (a heating mode). Normally, all of the heat sinks 240 are positioned at the first contact position, and all of the unit heads 2*y* are kept in the cooling mode.

Figure 9:
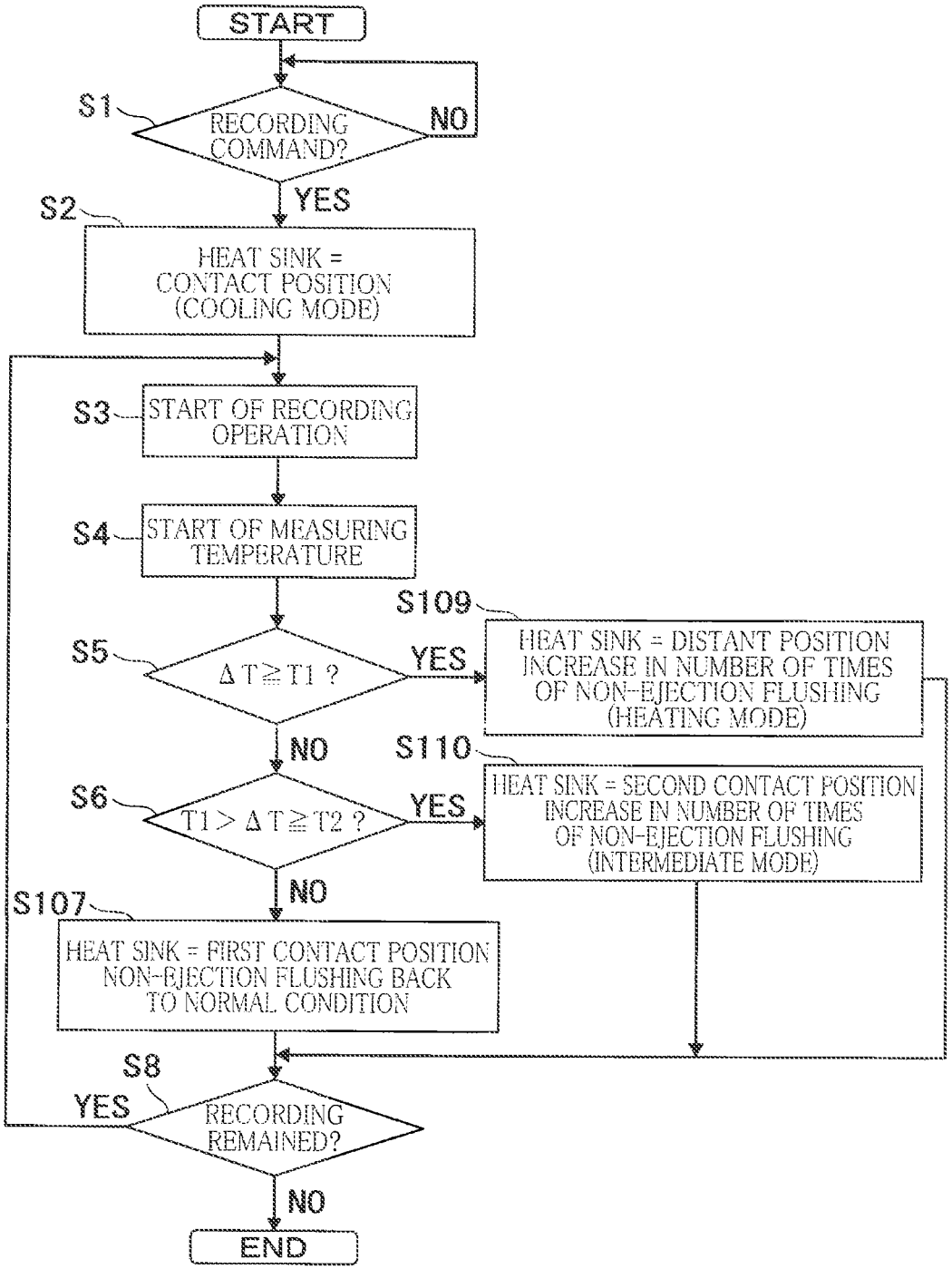
FIG. 9 is a flow chart showing an operation executed by a controller of the inkjet printer as the second embodiment.

Further, the operations executed by the controller 1*p* in the second embodiment will be described with reference to FIG. 9. In the second embodiment, the controller 1*p* controls for the non-ejection flushing similar to the first embodiment and performs the identical operations with those in the first embodiment. Hereinafter, the operations executed by the controller 1*p* in the second embodiment and the operations different from those in the first embodiment will be described. In FIG. 9, the identical operations with those in FIG. 7 will be denoted by the step numbers used in the first embodiment.

When the temperature control circuit 53*c* judges that ΔT≥T1 (S5: YES), S109 is executed instead of S9. Further, when the temperature control circuit 53*c* judges that ΔT≥T2 (S6: YES), S110 is executed instead of S10. Furthermore, when the temperature control circuit 53*c* judges that ΔT<T2 (S6: NO), the temperature control circuit 53*c* executes S107 instead of S7. Hereinafter, S107, S109 and S110 will be described.

In S107, it is judged that the difference in temperature ΔT between the two channel members 20 does not influence the recording quality, a condition of the non-ejection flushing is returned to the normal condition. As shown in FIG. 8A, the heat sink 240 is also positioned again at the first contact position. In a state in which the heat sink 240 is positioned at the first contact position, the contact area of the leaf spring 40*s* with the corresponding one of the unit heads 2*y* becomes the largest among the three positions. After that, the corresponding one of the unit heads 2*y* is driven in the cooling mode.

In S109, not only the heat sink 240 is positioned at the distant position, as shown in FIG. 8C, but also the leaf spring 40*s* that is attached to the heat sink 240 is spaced apart from the corresponding one of the unit heads 2*y*. The number of times of the non-ejection flushing becomes greater than that in the normal condition, similarly in the first embodiment. After that, the corresponding one of the unit heads 2*y* is driven in the heating mode. Then, as the difference in temperature ΔT decreases, the corresponding one of the unit heads 2*y* is driven in the intermediate mode, and then driven again in the cooling mode.

In S110, the heat sink 240 is positioned at the second contact position at which the heat sink 240 is intermediately in contact with the corresponding one of the unit heads 2*y*. The number of times of the non-ejection flushing becomes greater than that in the normal condition, similarly in the first embodiment. Then, the corresponding one of the unit heads 2*y* is driven in the intermediate mode. After that, when the difference in temperature ΔT decreases, the corresponding one of the unit heads 2*y* is driven again in the cooling mode. On the other hand, when the difference in temperature ΔT increases, the corresponding one of the unit heads 2*y* is driven in the heating mode (S5: YES).

As described above, in the second embodiment, the identical structures with those in the first embodiment can take the identical effects with those in the first embodiment, and the second embodiment can also enjoy the following effects.

The heat sink 240 comprises the leaf spring 40*s* that is constructed such that, depending on the distance between the leaf spring 40*s* and the corresponding one of the unit heads 2*y*, the contact area of the leaf spring 40*s* with the corresponding one of the unit heads 2*y* is variable. The heat resistance of the heat sink 240 with respect to the corresponding one of the unit heads 2*y* is changed depending on the contact area of the leaf spring 40*s* with the corresponding one of the unit heads 2*y*. In this embodiment, the temperature of the unit head 2*y* can be more finely controlled. In other words, in the present embodiment, compared to a case where the temperature of the unit head is controlled by the heat sink simply being in contact with or being spaced apart from the unit head and controlled by changing of the condition of the non-ejection flushing, a restricted cooling power by the heat sink 240 further affects the corresponding one of the unit heads 2*y*, so that an excessive change in temperature of each of the unit heads 2*y* (especially, the driver IC 27) can be restrained, and the difference in temperature ΔT can be smoothly decreased.

Furthermore, the present embodiment can enjoy the above-described effects by such a relatively simple structure as the leaf spring 40*s*.

Figure 10A:
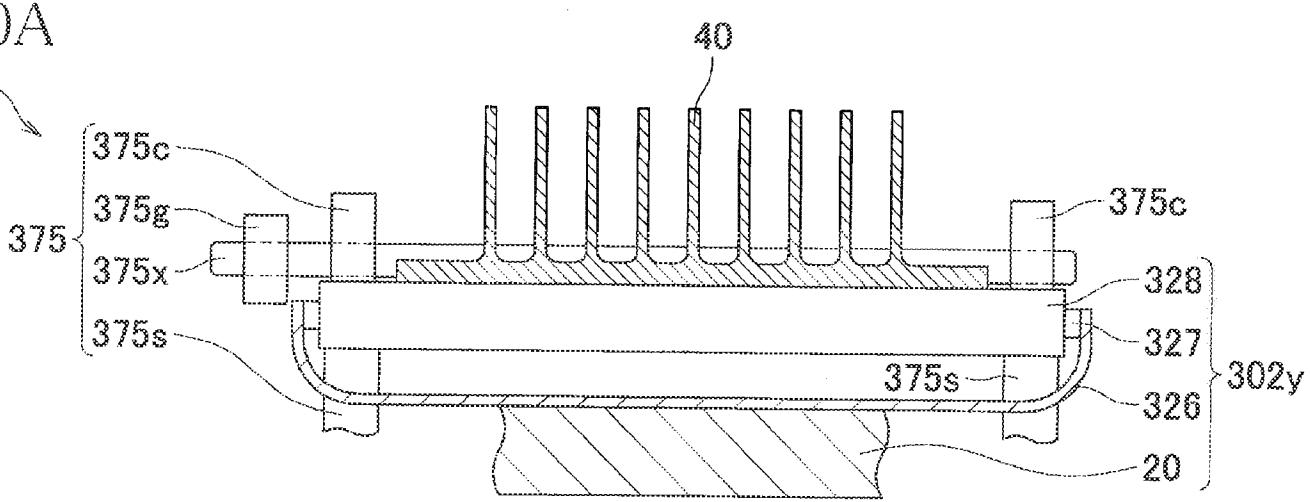
FIG. 10A is a cross-sectional view corresponding to FIGS. 5A and 5B showing an inkjet printer as a third embodiment and showing a state in which a heat sink is positioned at a contact position (a cooling mode)
Figure 10B:
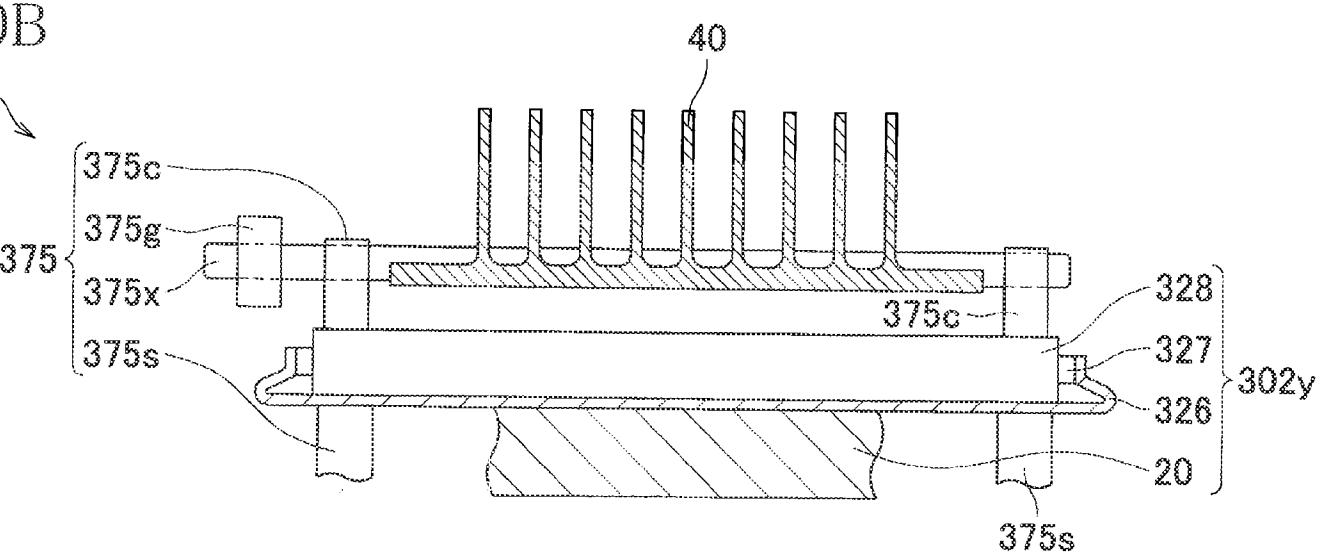
FIG. 10B is a cross-sectional view corresponding to FIGS. 5A and 5B showing the inkjet printer as the third embodiment and showing a state in which the heat sink is positioned at a distant position (a heating mode).

Hereinafter, there will be described an inkjet printer as a third embodiment to which the present invention is applied with reference to FIGS. 10A and 10B.

The inkjet printer as the third embodiment is different from the printer 1 as the first embodiment in such a structure that each of the unit heads 302*y* comprises a heat transfer body 328 and in such a structure that an IC lifting mechanism 370 (an example of a heat-resistance change device and an example of a moving device) is disposed instead of the heat-sink lifting mechanism 70, and the other structures of the printer as the third embodiment are the identical with those of the printer I as the first embodiment.

The heat transfer body 328 holds two driver ICs 327 and is thermally connected to the driver ICs 327. The heat transfer body 328 is a plate member constituted by a good heat conductor (for example, metal such as aluminum, copper and the like). Each of the two driver ICs 327 is fixed to a corresponding one of opposite side surfaces of the heat transfer body 328. When the piezoelectric actuator is driven, the heat of each of the two driver ICs 327 is transmitted to the heat transfer body 328. The two driver ICs 327 and the heat transfer body 328 are thermally connected to the channel member 20 through a COF (Chip On Film) 326 (an example of wiring member).

The driver ICs 327 and the heat transfer body 328 are capable of moving up and down by driving of the IC lifting mechanism 370. Accordingly, each of the heat sinks 40 is relatively moved to a corresponding one of the unit heads 2*y*. The heat transfer body 328 is selectively positioned at a contact position of the heat sink 40 (a position shown in FIG. 10A) at which the heat transfer body 328 is in contact with the heat sink 40, and at a distant position of the heat sink 40 (a position shown in FIG. 10B) at which the heat transfer body 238 is in contact with the channel member 20.

The IC lifting mechanism 370 has the identical structure with the heat-sink lifting mechanism 70, and one IC lifting mechanism 370 is disposed corresponding to two heat transfer bodies 328 that are arranged adjacent to each other. In other words, in total, three IC lifting mechanisms 370 are disposed corresponding to six heat transfer bodies 328.

Each of the IC lifting mechanisms 370 comprises a common portion which is common to the two heat transfer body 328 and an individual portion 375 which is disposed for each of the six heat transfer bodies 328. The common portion has the identical structure with the common portion 71 in the first embodiment. The individual portion 375 comprises a gear 375*g* which is allowed to mesh with the gear 71*g* of the common portion, two cams 375*c* disposed on an upper surface of the heat transfer body 328 so as to be opposed to each other, a Shaft 375*x* which functions as a rotation shaft of the gear 375*g* and the two cams 375*c*, and four springs 375*s* disposed on a lower surface of the heat transfer body 328.

The IC lifting mechanism 370 drives in the same manner as the heat-sink lifting mechanism 70. That is, when the lifting motor 71M drives in a state in which the clutch 71*c* is positioned at the first position or the second position, the rotation of the lifting motor 71M is transmitted through the gear 71*g* to the gear 375*g* of the individual portion 375 of one or the other of the two transfer bodies 328 adjacent to each other, and the two cams 375*c* are rotated with the rotation of the gear 375*g*. With the rotation of the gear 375*g*, the driver ICs 327 and the heat transfer body 328 are moved up or down. The four springs 375*s* apply a force to the heat transfer body 328 over an entire area of a movable range of the heat transfer body 328. When the heat sink 40 is positioned at the contact position (the position shown in FIG. 10A), the two cams 375*c* is slightly spaced apart from the upper surface of the heat transfer body 328 such that the heat transfer body 328 receives the force from the springs 375*s*. When the heat sink 40 is positioned at the distant position (the position shown in FIG. 10B), the two cams 375*c* are in contact with the upper surface of the heat transfer body 328 such that the two cams 375*c* receives the force from the springs 375*s*.

As described above, in the third embodiment, the identical structures with those in the first embodiment can take the identical effects with those in the first embodiment, and the third embodiment can also enjoy the following effects.

In a case where, when the position of the heat sink 40 is switched, the whole unit head 302*y* is moved, it is difficult to reproduce the position of the unit head 302*y* and there is possibility that a failure in recording occurs. On the other hand, the present embodiment adopts such a structure that the driver ICs 327 and the heat transfer body 328 are moved by the IC lifting mechanism 370, so that the above-described problem can be reduced and a relative movement of the heat sink 40 and the unit head 302*y* can be realized.

In a case where there is no member like the heat transfer body 328, and the heat sink 40 is in contact with the driver IC 327 when the heat sink 40 is positioned at the contact position, and the heat sink 40 is spaced apart from the driver IC 327 when the heat sink 40 is positioned at the distant position, such a problem may occur that, when the position of the heat sink 40 is switched from the contact position to the distant position, a temperature of the driver IC 327 immediately rises to reach the upper limit temperature. Also, in this case, even in a state in which the heat sink 40 is positioned at the distant position, only the COF 326 is disposed without the heat transfer body 328, so that the heat resistance of the heat sink 40 is relatively large. Therefore, it is hard that the heat is transmitted from the driver ICs 327 to the channel member 20, and such a problem may occur that the temperature of the channel member 20 cannot be increased effectively. On the other hand, in the present embodiment, by adopting the heat transfer body 326, the above-described problem can be reduced.

The present invention is not limited to the illustrated embodiments. It is to be understood that the present invention may be embodied with various changes and modifications that may occur to a person skilled in the art, without departing from the spirit and scope of the invention defined in the appended claims.

In the second embodiment, the heat sink 240 is controlled to be selectively positioned at one of the three positions (the first contact position, the second contact position, and the distant position), but three or more contact positions may be set. In this case, the temperature of the channel member 20 can be controlled more finely.

In the third embodiment, in a state in which the heat sink 40 is positioned at the distant position, the heat transfer body 328 may directly contact the channel member 20 without the COF 326. The above-described structures in the first, second, and third embodiments may be combined. For example, in the third embodiment, a heat sink having the leaf spring 40*s* in the second embodiment may be adopted.

The controller may control the position of the heat sink without increasing the frequency of the non-ejection flushing. It is preferable that the controller controls the temperature of the channel member in consideration of the upper limit temperature of the drive circuit. The controller may control the temperature of not all of the channel members, a part of the channel members. For example, the six channel members may be divided into three groups each comprising the two channel members, and the controller may control, based on the difference in temperature between the two channel members included in each of the three groups, the heat resistance of the radiator corresponding to one of the two channel members is greater than the heat resistance of the radiator corresponding to the other of the two channel members.

Further, at least the heat resistance of the radiator corresponding to a lower one in temperature of the two channel members may be increased in order not to exceed the heat resistance of the radiator corresponding to a higher one in temperature of the two channel members. At least the frequency of the non-ejection flushing of the unit head corresponding to a lower one in temperature of the two channel members may be increased. Furthermore, at least the frequency of the non-ejection flushing of the unit head corresponding to a lower one in temperature of the two channel members may be increased in order not to exceed the frequency of the non-ejection flushing of the unit head corresponding to a higher one in temperature of the two channel members.

The radiator, at the contact position thereof, may be in contact with the channel member of the liquid ejection head or a portion of the liquid ejection head that is thermally connected to the channel member, and the present invention is not limited to such a structure that the radiator is in contact with the heat body. The wiring member is not limited to the CUE, and the wiring member may be a FPC (Flexible Printed Circuit) and so on. There may exist a member such as sponge between the wiring member and the channel member. Even in this case, as long as the heat body is thermally connected to the channel member, the problems for the present invention to be solved may occur.

The moving device is not limited to moving of the radiator of the heat body, and the moving device may move the channel member. Further, the moving device may move both of the radiator and the liquid ejection head. The moving device may comprise any mechanism other than a mechanism constituted by cams.

The heat-resistance change device does not necessarily comprise the moving device. For example, the heat resistance may be changed by changing of a speed and/or a temperature of air that is sent from a fan, or by changing of voltage of the Peltier device. An element which applies energy for a liquid ejection from ejection openings to liquid in a channel of the channel member is not limited to the piezoelectric element and may be an electrostatic element, a resistance heating element and the like.

The above-described embodiments illustrates, as a plurality of liquid ejection heads, a plurality of unit heads 2*y* that are disposed to be spaced apart from each other. In this embodiment, since a thermal connection between the plurality of unit heads 2*y* is weak, a temperature distribution as one head 2 is not smooth. The temperature distribution between the plurality of unit heads 2*y* tends to be changed in a stepped manner. The present invention is especially effective to make such temperature distribution smooth. The present invention is not limited to the plurality of liquid ejection heads that are spaced apart from each other, and the plurality of liquid ejection heads may be integrally formed. The liquid ejection head is not limited to the line-type, and may be a serial-type. Liquid ejected from the liquid ejection head is not limited to ink, and may be any liquid (for example, pretreatment liquid). A liquid ejection apparatus to which the present invention is applied is not limited to a printer, and may be a facsimile, a copier, or the like. A recording medium is not limited to a sheet, and may be any recordable medium.

What is claimed is:

1. A liquid ejection apparatus comprising:

a plurality of liquid ejection heads each comprising a channel member having a plurality of ejection openings through which liquid is ejected and a plurality of channels configured to be communicated with the plurality of ejection openings, and a heat body configured to be thermally connected to the channel member and configured to generate heat when energy is applied to liquid in the plurality of channels such that the liquid is ejected through the plurality of ejection openings;

a plurality of radiators each provided for each of the plurality of liquid ejection heads;

a plurality of temperature sensors each provided for each of the plurality of liquid ejection heads and each configured to output a signal indicating a temperature of the channel member of a corresponding one of the plurality of liquid ejection heads;

a heat-resistance change device configured to change a heat resistance between one of the plurality of radiators and one of the plurality of liquid ejection heads corresponding to the one of the plurality of radiators; and a controller configured to control the heat-resistance change device based on the signal outputted from at least one of the plurality of temperature sensors.

2. The liquid ejection apparatus according to claim 1, wherein the controller is configured to control the heat-resistance change device based on the signal so as to, when a temperature difference between two of the plurality of channel members is equal to or greater than a first value, increase the heat resistance between one of the plurality of radiators and one of the plurality of liquid ejection heads each corresponding to a lower one in temperature of the two of the plurality of channel members.

3. The liquid ejection apparatus according to claim 2, wherein the controller is configured to control at least one of the plurality of ejection heads based on the signal so as to, when the temperature difference between two of the plurality of channel members is greater than the first value, increase a frequency of non-ejection flushing to the plurality of ejection openings of the lower one in temperature of the two of the plurality of channel members, the non-ejection flushing being performed in such a way that a meniscus of the liquid formed in each of the plurality of ejection openings is oscillated without ejection of the liquid through the plurality of the ejection openings.

4. The liquid ejection apparatus according to claim 1, wherein the controller is configured to control the heat-resistance change device based on the signal such that, when a temperature difference between two of the plurality of channel members is equal to or greater than a first value, at least the heat resistance between one of the plurality of radiators and one of the plurality of liquid ejection heads each corresponding to a lower one in temperature of the two of the plurality of channel members becomes greater than the heat resistance between one of the plurality of radiators and one of the plurality of liquid ejection heads each corresponding to a higher one in temperature of the two of the plurality of channel members.

5. The liquid ejection apparatus according to claim 1, wherein the controller is configured to control the heat-resistance change device based on the signal such that, when a temperature difference between two of the plurality of channel members is equal to or greater than a first value, at least the heat resistance between one of the plurality of radiators and one of the plurality of liquid ejection heads each corresponding to the lowest one in temperature of the plurality of channel members becomes greater than the heat resistance between one of the plurality of radiators and one of the plurality of liquid ejection heads each corresponding to the highest one in temperature of the plurality of channel members.

6. The liquid ejection apparatus according to claim 5, wherein the controller is configured to control the heat-resistance change device based on the signal such that:

when the temperature difference between two of the plurality of channel members is smaller than the first value, the heat resistance between each of the plurality of radiators and a corresponding one of the plurality of ejection heads becomes the smallest value within a range in which the heat resistance is variable; and when the temperature difference between two of the plurality of channel members is equal to or greater than the first value, at least the heat resistance between one of the plurality of radiators and one of the plurality of ejection heads each corresponding to the lowest one in temperature of the plurality of channel members becomes greater than the smallest value.

7. The liquid ejection apparatus according to claim 5, wherein the controller is configured to control at least one of the plurality of liquid ejection heads based on the signal such that, when the temperature difference between the two of the plurality of channel members is equal to or greater than a second value which is smaller than the first value, the frequency of non-ejection flushing to the plurality of ejection openings of the lowest one in temperature of the plurality of channel members becomes greater than the frequency of the non-ejection flushing to the plurality of ejection openings of the highest one in temperature of the plurality of channel members, the non-ejection flushing being performed in such a way that a meniscus of the liquid formed in each of the plurality of ejection openings is oscillated without ejection of the liquid through the plurality of the ejection openings.

8. The liquid ejection apparatus according to claim 1, wherein the heat-resistance change device comprises a moving device configured to more the one of the plurality of radiators relatively to the one of the plurality of liquid ejection heads corresponding to the one of the plurality of radiators, wherein the controller is configured to control the moving device based on the signal such that the one of the plurality of radiators is selectively positioned at a contact position where the one of the plurality of radiators is held in contact with the one of the plurality of liquid ejection heads, and at a distant position where the one of the plurality of radiators is spaced apart from the corresponding one of the plurality of liquid ejection heads.

9. The liquid ejection apparatus according to claim 8, wherein each of the plurality of radiators is configured to, in a state in which each of the plurality of radiators is positioned at the contact position, be held in contact with the heat body of a corresponding one of the plurality of liquid ejection heads.

10. The liquid ejection apparatus according to claim 8, wherein the moving device is configured to move each of the plurality of radiators.

11. The liquid ejection apparatus according to claim 10, wherein each of the plurality of liquid ejection heads further comprises:

a wiring member configured to be attached to the channel member and having wires for applying energy to the liquid in the plurality of channels;

a drive circuit configured to be attached to a portion of the wiring member which is spaced apart from the channel member and configured to supply a drive signal through the wires; and a heat transfer body configured to hold the drive circuit and configured to be thermally connected to the drive circuit, wherein the drive circuit and the heat transfer body constitute the heat body and are configured to be thermally connected to the channel member through the wiring member, wherein, in each of the plurality of liquid ejection heads, in a state in which the one of the plurality of radiators is positioned at the contact position, the heat transfer body is spaced apart from the channel member, and the heat transfer body is held in contact with the one of the plurality of radiators, and in each of the plurality of liquid ejection heads, in a state in which the one of the plurality of radiators is positioned at the distant position, the heat transfer body is held in contact with the channel member and is spaced apart from the one of the plurality of radiators.

12. The liquid ejection apparatus according to claim 8, wherein the moving device is configured to move the heat body of each of the plurality of liquid ejection heads.

13. The liquid ejection apparatus according to claim 1, wherein the heat-resistance change device comprises a moving device configured to move the one of the plurality of radiators relatively to the one of the plurality of liquid ejection heads corresponding to the one of the plurality of radiators, wherein the controller is configured to control the moving device based on the signal such that the one of the plurality of radiators is selectively positioned at a contact position at which the one of the plurality of radiators is held in contact with the one of the plurality of liquid ejection heads, and at a distant position at which the one of the plurality of radiators is spaced apart from the corresponding one of the plurality of liquid ejection heads, wherein each of the plurality of radiators comprises an area change device disposed at a surface opposed to a corresponding one of the plurality of liquid ejection heads and configured to change a contact area with the corresponding one of the plurality of liquid ejection heads according to a distance between the area change device and the corresponding one of the plurality of liquid ejection heads, wherein the area change device constitutes the heat-resistance change device.

14. The liquid ejection apparatus according to claim 13, wherein the area change device comprises a leaf spring.

* * * * *